US009028276B2

(12) United States Patent
Wilson et al.

(10) Patent No.: US 9,028,276 B2
(45) Date of Patent: May 12, 2015

(54) COAXIAL CABLE CONTINUITY DEVICE

(71) Applicant: PCT International, Inc., Mesa, AZ (US)

(72) Inventors: Brandon Wilson, Phoenix, AZ (US); Paul Sterkeson, Mesa, AZ (US); Timothy L. Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 33 days.

(21) Appl. No.: 13/707,403

(22) Filed: Dec. 6, 2012

(65) Prior Publication Data

US 2013/0143438 A1 Jun. 6, 2013

Related U.S. Application Data

(60) Provisional application No. 61/567,589, filed on Dec. 6, 2011.

(51) Int. Cl.

| | |
|---|---|
| ***H01R 9/05*** | (2006.01) |
| ***H01R 24/40*** | (2011.01) |
| ***H01R 24/38*** | (2011.01) |
| *H01R 13/6598* | (2011.01) |

(52) U.S. Cl.

CPC ..... *H01R 9/0524* (2013.01); *H01R 9/0512* (2013.01); *H01R 24/40* (2013.01); *H01R 24/38* (2013.01); *H01R 9/05* (2013.01); *H01R 13/6598* (2013.01)

(58) Field of Classification Search

USPC ..... 439/322, 578

See application file for complete search history.

(56) References Cited

U.S. PATENT DOCUMENTS

| | | | |
|---|---|---|---|
| 2,178,365 | A | 10/1939 | Brobst |
| 2,232,846 | A | 2/1941 | Freydberg |
| 2,233,216 | A | 2/1941 | Matthysse |
| 2,304,711 | A | 12/1942 | Shenton |
| D140,861 | S | 4/1945 | Conlan |
| 2,669,695 | A | 9/1952 | Bird |
| 3,076,235 | A | 2/1963 | Rollins et al. |
| 3,229,623 | A | 1/1966 | Rubinstein et al. |
| 3,274,447 | A | 9/1966 | Nelson |
| 3,275,737 | A | 9/1966 | Caller |

(Continued)

FOREIGN PATENT DOCUMENTS

| | | |
|---|---|---|
| DE | 3111832 | 10/1982 |
| DE | 10050445 | 4/2002 |

(Continued)

OTHER PUBLICATIONS

U.S. Appl. No. 13/111,807, filed May 19, 2011, Youtsey.

(Continued)

*Primary Examiner* — Neil Abrams
*Assistant Examiner* — Travis Chambers
(74) *Attorney, Agent, or Firm* — Perkins Coie LLP

(57) ABSTRACT

A jumper sleeve configured to be installed on an outer side of a male F-connector to facilitate easy connection of and maintain ground continuity across the male F-connector and a female F-connector. In one embodiment, a conductive element is installed on an inner surface of the jumper sleeve and conductively engages an outer surface of the male F-connector to maintain ground continuity across the male and female F-connectors.

41 Claims, 9 Drawing Sheets

(56) References Cited

U.S. PATENT DOCUMENTS 3,344,227 A 9/1967 Gilmartin et al.
3,366,920 A 1/1968 Laudig et al.
3,379,824 A 4/1968 Kempf
3,390,374 A 6/1968 Forney, Jr.
3,489,988 A 1/1970 Carnaghan
3,517,375 A 6/1970 Mancini
3,544,705 A 12/1970 Winston
3,601,776 A 8/1971 Curl
3,609,651 A 9/1971 Sladek et al.
3,653,689 A 4/1972 Sapy et al.
3,662,090 A 5/1972 Grey
3,671,922 A 6/1972 Zerlin et al.
3,708,781 A 1/1973 Trompeter
3,740,453 A 6/1973 Callaghan et al.
3,746,931 A 7/1973 Muranaka
3,777,298 A 12/1973 Newman
3,778,535 A 12/1973 Forney, Jr.
3,836,700 A 9/1974 Niemeyer
3,863,111 A 1/1975 Martzloff
4,029,006 A 6/1977 Mercer
4,096,346 A 6/1978 Stine et al.
4,100,003 A 7/1978 Trusch
4,117,260 A 9/1978 Wilkenloh
4,125,739 A 11/1978 Bow
4,159,859 A 7/1979 Shemtov
4,221,926 A 9/1980 Schneider
4,225,162 A 9/1980 Dola
4,307,926 A 12/1981 Smith
4,371,742 A 2/1983 Manly
4,400,050 A 8/1983 Hayward
4,408,822 A 10/1983 Nikitas
4,439,632 A 3/1984 Aloisio, Jr. et al.
4,465,717 A 8/1984 Crofts et al.
4,472,595 A 9/1984 Fox et al.
4,484,023 A 11/1984 Gindrup
4,487,996 A 12/1984 Rabinowitz et al.
4,509,090 A 4/1985 Kawanami et al.
4,515,992 A 5/1985 Gupta
RE31,995 E 10/1985 Ball
4,557,560 A 12/1985 Bohannon, Jr. et al.
4,564,723 A 1/1986 Lang
4,569,704 A 2/1986 Bohannon, Jr. et al.
4,572,692 A 2/1986 Sauber
4,595,431 A 6/1986 Bohannon, Jr. et al.
4,604,773 A 8/1986 Weber et al.
4,619,497 A 10/1986 Vogel et al.
4,633,359 A 12/1986 Mickelson et al.
4,641,110 A 2/1987 Smith
4,684,201 A 8/1987 Hutter
4,691,081 A 9/1987 Gupta et al.
4,718,854 A 1/1988 Capp et al.
4,729,629 A 3/1988 Saito et al.
4,755,152 A 7/1988 Elliot et al.
4,760,362 A 7/1988 Maki
4,774,148 A 9/1988 Goto
4,875,864 A 10/1989 Campbell
4,894,488 A 1/1990 Gupta
4,915,651 A 4/1990 Bout
4,965,412 A 10/1990 Lai et al.
4,990,106 A 2/1991 Szegda
4,997,994 A 3/1991 Andrews et al.
5,011,432 A 4/1991 Sucht et al.
5,041,020 A 8/1991 Michael
5,043,538 A 8/1991 Hughey, Jr. et al.
5,043,539 A 8/1991 Connole et al.
5,049,721 A 9/1991 Parnas et al.
5,073,129 A 12/1991 Szegda
5,083,943 A 1/1992 Tarrant
5,096,444 A 3/1992 Lu et al.
5,123,863 A 6/1992 Frederick et al.
5,132,491 A 7/1992 Mulrooney et al.
5,141,448 A 8/1992 Mattingly et al.
5,145,382 A 9/1992 Dickirson
5,147,221 A 9/1992 Cull et al.
5,161,993 A 11/1992 Leibfried, Jr.
5,195,905 A 3/1993 Pesci
5,195,910 A 3/1993 Enomoto et al.
5,198,958 A 3/1993 Krantz, Jr.
5,205,547 A 4/1993 Mattingly
5,216,202 A 6/1993 Yoshida et al.
5,217,393 A 6/1993 Del Negro et al.
5,237,293 A 8/1993 Kan et al.
5,276,415 A 1/1994 Lewandowski et al.
5,281,167 A 1/1994 Le et al.
5,284,449 A 2/1994 Vaccaro
5,295,864 A 3/1994 Birch et al.
5,306,170 A 4/1994 Luu
5,316,348 A 5/1994 Franklin
5,318,458 A 6/1994 Thorner
5,329,064 A 7/1994 Tash et al.
5,355,720 A 10/1994 Bailey
5,367,925 A 11/1994 Gasparre
5,383,708 A 1/1995 Nagasaka et al.
5,412,856 A 5/1995 Nazerian et al.
5,414,213 A 5/1995 Hillburn
5,439,399 A 8/1995 Spechts et al.
5,470,257 A 11/1995 Szegda
5,471,144 A 11/1995 Meyer
5,493,070 A 2/1996 Habu
5,498,175 A 3/1996 Yeh et al.
5,507,537 A 4/1996 Meisinger et al.
5,521,331 A 5/1996 Hillburn
5,525,076 A 6/1996 Down
5,548,088 A 8/1996 Gray et al.
5,560,536 A 10/1996 Moe
5,564,938 A 10/1996 Shenkal et al.
5,595,499 A 1/1997 Zander et al.
5,607,325 A 3/1997 Toma
5,632,633 A 5/1997 Roosdorp et al.
5,632,651 A 5/1997 Szegda
5,651,698 A 7/1997 Locati et al.
5,660,565 A 8/1997 Williams
5,667,409 A 9/1997 Wong et al.
5,700,160 A 12/1997 Lee
5,707,465 A 1/1998 Bibber
5,719,353 A 2/1998 Carlson et al.
5,724,220 A 3/1998 Chaudhry
5,730,622 A 3/1998 Olson
5,796,042 A 8/1998 Pope
5,829,992 A 11/1998 Merker et al.
5,830,010 A 11/1998 Miskin et al.
5,857,711 A 1/1999 Comin-DuMong et al.
5,860,833 A 1/1999 Chillscyzn et al.
5,863,226 A 1/1999 Lan et al.
5,865,654 A 2/1999 Shimirak et al.
5,882,233 A 3/1999 Idehara
5,890,762 A 4/1999 Yoshida
5,905,942 A 5/1999 Stoel
5,926,949 A 7/1999 Moe et al.
5,927,975 A 7/1999 Esrock
5,938,465 A 8/1999 Fox, Sr.
5,945,632 A 8/1999 Butera
5,949,018 A 9/1999 Esker
5,953,195 A 9/1999 Pagliuca
5,959,245 A 9/1999 Moe et al.
5,969,295 A 10/1999 Boucino et al.
5,984,378 A 11/1999 Ostrander et al.
5,991,136 A 11/1999 Kaczmarek et al.
5,992,010 A * 11/1999 Zamanzadeh ..... 29/747
6,010,349 A 1/2000 Porter, Jr.
6,011,218 A 1/2000 Burek et al.
6,024,408 A 2/2000 Bello et al.
6,027,373 A 2/2000 Gray et al.
6,037,545 A 3/2000 Fox et al.
6,042,422 A 3/2000 Youtsey
6,048,233 A 4/2000 Cole
6,065,997 A 5/2000 Wang
6,071,144 A 6/2000 Tang
6,087,017 A 7/2000 Bibber
6,109,963 A 8/2000 Follingstad et al.
6,113,431 A 9/2000 Wong
6,127,441 A 10/2000 Sakamoto et al.
6,137,058 A 10/2000 Moe et al.
6,140,582 A 10/2000 Sheehan

(56) References Cited

U.S. PATENT DOCUMENTS

| | | | | |
|---|---|---|---|---|
| 6,142,788 | A | 11/2000 | Han | |
| 6,146,196 | A | 11/2000 | Burger et al. | |
| 6,148,130 | A | 11/2000 | Lee et al. | |
| 6,174,206 | B1 | 1/2001 | Yentile et al. | |
| 6,183,297 | B1 | 2/2001 | Kay et al. | |
| 6,183,298 | B1 | 2/2001 | Henningsen | |
| 6,201,189 | B1 | 3/2001 | Carlson et al. | |
| 6,201,190 | B1 | 3/2001 | Pope | |
| 6,204,445 | B1 | 3/2001 | Gialenios et al. | |
| 6,210,221 | B1 | 4/2001 | Maury | |
| 6,210,222 | B1 | 4/2001 | Langham et al. | |
| 6,246,006 | B1 | 6/2001 | Hardin et al. | |
| 6,249,415 | B1 | 6/2001 | Daoud et al. | |
| 6,250,960 | B1 | 6/2001 | Youtsey | |
| 6,265,667 | B1 | 7/2001 | Stipes et al. | |
| 6,282,778 | B1 | 9/2001 | Fox et al. | |
| 6,288,628 | B1 | 9/2001 | Fujimori | |
| 6,326,551 | B1 | 12/2001 | Adams | |
| 6,371,585 | B2 | 4/2002 | Kurachi | |
| 6,372,990 | B1 | 4/2002 | Saito et al. | |
| 6,384,337 | B1 | 5/2002 | Drum | |
| 6,396,367 | B1 | 5/2002 | Rosenberger | |
| D459,306 | S | 6/2002 | Malin | |
| 6,417,454 | B1 | 7/2002 | Biebuyck | |
| 6,450,836 | B1 | 9/2002 | Youtsey | |
| 6,462,436 | B1 | 10/2002 | Kay et al. | |
| 6,468,100 | B1 | 10/2002 | Meyer et al. | |
| 6,498,301 | B1 | 12/2002 | Pieper et al. | |
| 6,540,293 | B1 | 4/2003 | Quackenbush | |
| 6,545,222 | B2 | 4/2003 | Yokokawa et al. | |
| 6,591,055 | B1 | 7/2003 | Eslambolchi et al. | |
| 6,596,393 | B1 | 7/2003 | Houston et al. | |
| 6,610,931 | B2 | 8/2003 | Perelman et al. | |
| 6,648,683 | B2 | 11/2003 | Youtsey | |
| 6,712,631 | B1 | 3/2004 | Youtsey | |
| 6,734,364 | B2 | 5/2004 | Price et al. | |
| 6,770,819 | B2 | 8/2004 | Patel | |
| 6,798,310 | B2 | 9/2004 | Wong et al. | |
| 6,800,809 | B2 | 10/2004 | Moe et al. | |
| 6,800,811 | B1 | 10/2004 | Boucino | |
| 6,817,272 | B2 * | 11/2004 | Holland | 81/124.2 |
| 6,818,832 | B2 | 11/2004 | Hopkinson et al. | |
| 6,846,536 | B1 | 1/2005 | Priesnitz et al. | |
| 6,848,939 | B2 | 2/2005 | Stirling | |
| 6,858,805 | B2 | 2/2005 | Blew et al. | |
| 6,875,928 | B1 | 4/2005 | Hayes et al. | |
| 6,877,996 | B1 | 4/2005 | Franks, Jr. | |
| 6,915,564 | B2 | 7/2005 | Adams | |
| D508,676 | S | 8/2005 | Franks, Jr. | |
| 6,997,999 | B2 | 2/2006 | Houston et al. | |
| 7,022,918 | B2 | 4/2006 | Gialenios et al. | |
| 7,052,283 | B2 * | 5/2006 | Pixley et al. | 439/620.03 |
| 7,077,475 | B2 | 7/2006 | Boyle | |
| 7,084,343 | B1 | 8/2006 | Visser | |
| 7,127,806 | B2 | 10/2006 | Nelson et al. | |
| 7,131,868 | B2 | 11/2006 | Montena | |
| 7,144,273 | B1 | 12/2006 | Chawgo | |
| 7,147,509 | B1 | 12/2006 | Burris et al. | |
| 7,157,645 | B2 | 1/2007 | Huffman | |
| 7,159,948 | B1 | 1/2007 | Wolf | |
| 7,183,743 | B2 | 2/2007 | Geiger | |
| 7,198,495 | B1 | 4/2007 | Youtsey | |
| 7,210,940 | B2 * | 5/2007 | Baily et al. | 439/38 |
| 7,278,684 | B2 | 10/2007 | Boyle | |
| 7,299,550 | B2 | 11/2007 | Montena | |
| 7,306,484 | B1 | 12/2007 | Mahoney et al. | |
| 7,311,555 | B1 | 12/2007 | Burris et al. | |
| 7,314,998 | B2 | 1/2008 | Amato et al. | |
| 7,350,767 | B2 | 4/2008 | Huang | |
| 7,404,737 | B1 | 7/2008 | Youtsey | |
| 7,468,489 | B2 | 12/2008 | Alrutz | |
| 7,497,002 | B2 | 3/2009 | Chawgo | |
| 7,500,874 | B2 | 3/2009 | Montena | |
| 7,507,117 | B2 | 3/2009 | Amidon | |
| 7,513,795 | B1 | 4/2009 | Shaw | |
| 7,566,236 | B2 | 7/2009 | Malloy et al. | |
| 7,635,283 | B1 | 12/2009 | Islam | |
| 7,785,144 | B1 | 8/2010 | Islam | |
| 7,837,501 | B2 | 11/2010 | Youtsey | |
| 7,841,912 | B2 | 11/2010 | Hachadorian | |
| 7,857,661 | B1 | 12/2010 | Islam | |
| 7,887,354 | B2 | 2/2011 | Holliday | |
| 8,016,612 | B2 * | 9/2011 | Burris et al. | 439/578 |
| 8,062,064 | B2 | 11/2011 | Rodrigues et al. | |
| 8,075,338 | B1 | 12/2011 | Montena | |
| 8,079,860 | B1 | 12/2011 | Zraik | |
| 8,113,875 | B2 | 2/2012 | Malloy et al. | |
| 8,113,879 | B1 | 2/2012 | Zraik | |
| 8,152,551 | B2 | 4/2012 | Zraik | |
| 8,157,589 | B2 | 4/2012 | Krenceski et al. | |
| 8,206,176 | B2 | 6/2012 | Islam | |
| 2002/0053446 | A1 | 5/2002 | Moe et al. | |
| 2002/0090856 | A1 | 7/2002 | Weisz-Margulescu | |
| 2003/0044606 | A1 | 3/2003 | Iskander | |
| 2003/0046706 | A1 | 3/2003 | Rakib | |
| 2004/0007308 | A1 | 1/2004 | Houston et al. | |
| 2004/0112356 | A1 | 6/2004 | Hatcher | |
| 2004/0222009 | A1 | 11/2004 | Blew et al. | |
| 2005/0042960 | A1 | 2/2005 | Yeh et al. | |
| 2005/0272311 | A1 | 12/2005 | Tsao | |
| 2006/0041922 | A1 | 2/2006 | Shapson | |
| 2006/0154522 | A1 | 7/2006 | Bernhart et al. | |
| 2006/0172571 | A1 | 8/2006 | Montena | |
| 2007/0291462 | A1 | 12/2007 | Peng | |
| 2008/0313691 | A1 | 12/2008 | Cholas et al. | |
| 2010/0033001 | A1 | 2/2010 | Boyer | |
| 2010/0276176 | A1 | 11/2010 | Amato | |
| 2011/0011638 | A1 | 1/2011 | Gemme et al. | |
| 2011/0011639 | A1 | 1/2011 | Visser | |
| 2011/0287653 | A1 | 11/2011 | Youtsey | |
| 2011/0318958 | A1 | 12/2011 | Burris et al. | |
| 2012/0045933 | A1 | 2/2012 | Youtsey | |
| 2012/0129387 | A1 | 5/2012 | Holland et al. | |

FOREIGN PATENT DOCUMENTS

| | | |
|---|---|---|
| EP | 1075698 | 2/2001 |
| EP | 1335390 | 8/2003 |
| GB | 2079549 | 1/1982 |
| JP | 64002263 | 1/1989 |
| JP | 2299182 | 12/1990 |
| JP | 05347170 | 12/1993 |
| JP | 2004128158 | 4/2004 |
| WO | WO-9310578 | 5/1993 |
| WO | WO-03013848 | 2/2003 |
| WO | WO2005006353 | 1/2005 |
| WO | WO-2011/009006 | 1/2011 |
| WO | WO-2011146911 | 11/2011 |
| WO | WO-2012158343 | 11/2012 |
| WO | WO-2012158344 | 11/2012 |
| WO | WO-2012158345 | 11/2012 |

OTHER PUBLICATIONS

U.S. Appl. No. 13/111,817, filed May 19, 2011, Youtsey.

U.S. Appl. No. 13/111,826, filed May 19, 2011, Youtsey.

"F-type connectors", ShowMe Cables, dated 2007 and printed on Jul. 9, 2008, 1 page, located at: http://www.showmecables.com/F-Type-Connectors.html.

Final Office Action dated Nov. 26, 2012; U.S. Appl. No. 13/113,027 (8 pages).

International Search Report and Written Opinion; PCT Application No. PCT/US2011/037477; Applicant: Youtsey, Timothy; Date of Mailing: Jul. 11, 2011, 11 pages.

International Search Report and Written Opinion; PCT Application No. PCT/US2011/042198; Applicant: PCT International, Inc.; Date of Mailing: Dec. 28, 2010, 9 pages.

International Search Report and Written Opinion; PCT Application No. PCT/US2012/36065; Applicant: PCT International, Inc.; Date of Mailing: May 24, 2012, 8 pages.

International Search Report and Written Opinion; PCT Application No. PCT/US12/36067; Applicant: PCT International, Inc.; Date of Mailing Oct. 1, 2012, 5 pages.

(56) References Cited

OTHER PUBLICATIONS

International Search Report and Written Opinion; PCT Application No. PCT/US2012/36068; Applicant: PCT International, Inc.; Date of Mailing: Jun. 4, 2012, 8 pages.
Latest quality F-connector Supply Information, China Quality F Connector list, Hardware-Wholesale.com, printed on Jul. 9, 2008, 6 pages, located at: http://www.hardware-wholesale.com/buy-F_Connector/.
Non-Final Office Action for Patent Application No. 12/605,868 dated Oct. 27, 2011 (13 pgs.).
Non-Final Office Action for U.S. Appl. No. 12/605,908 dated Oct. 24, 2011 (17 pgs).
Non-Final Office Action for U.S. Appl. No. 12/756,143 dated May 3, 2012 (7 pgs.).
Non-Final Office Action for U.S. Appl. No. 13/111,807 dated Apr. 30, 2012 ( 12 pgs.).
Non-Final Office Action for U.S. Appl. No. 13/111,817 dated Apr. 30, 2012 (7 pgs.).
Non-Final Office Action for U.S. Appl. No. 13/111,826 dated Apr. 30, 2012 (11 pgs.).
Non-Final Office Action for U.S. Appl. No. 13/113,027 dated May 11, 2012 (7 pgs.).
Non-Final Office Action; U.S. Appl. No. 13/213,823 dated Sep. 10, 2012 (6 pgs.).
"Pico/Macom GRB-I" and "Pico/Macom GRB-2" single and dual coax cable ground blocks, Stallions Satellite and Antenna—Grounding Products, dated Nov. 9, 2005 and printed Aug. 17, 2011, 3 pgs., located online at: http://web.archive.org/web/20051109024213/http://tvantenna.com/products/installation/grounding.html.
Non-Final Office Action; U.S. Appl. No. 13/213,823 dated Jan. 25, 2013 (11 pgs.).
Non-Final Office Action; U.S. Appl. No. 13/229,493 dated Feb. 1, 2013 (24 pgs.).
Non-Final Office Action for U.S. Appl. No. 12/605,908 mailed Nov. 12, 2013, 17 pages.
Final Office Action for U.S. Appl. No. 12/605,908, mailed Jun. 23, 2014, 22 pages.

* cited by examiner

COAXIAL CABLE CONTINUITY DEVICE

CROSS-REFERENCE TO RELATED APPLICATION(S)

This application claims priority to U.S. Provisional Patent Application No. 61/567,589, filed Dec. 6, 2011 and entitled "COAXIAL CABLE CONTINUITY DEVICE", which is incorporated herein in its entirety by reference.

TECHNICAL FIELD

The following disclosure relates generally to devices for facilitating connection, reducing RF interference, and/or grounding of F-connectors and other cable connectors.

BACKGROUND

Electrical cables are used in a wide variety of applications to interconnect devices and carry audio, video, and Internet data. One common type of cable is a radio frequency (RF) coaxial cable ("coaxial cable") which may be used to interconnect televisions, cable set-top boxes, DVD players, satellite receivers, and other electrical devices. Conventional coaxial cable typically consists of a central conductor (usually a copper wire), dielectric insulation, and a metallic shield, all of which are encased in a polyvinyl chloride (PVC) jacket. The central conductor carries transmitted signals while the metallic shield reduces interference and grounds the entire cable. When the cable is connected to an electrical device, interference may occur if the grounding is not continuous across the connection with the electrical device.

A connector, such as an "F-connector" (e.g., a male F-connector), is typically fitted onto an end of the cable to facilitate attachment to an electrical device. Male F-connectors have a standardized design, using a hexagonal rotational connecting ring with a relatively short length available for finger contact. The internal threads on the connecting ring require the male connector to be positioned exactly in-line with a female F-connector for successful thread engagement as rotation begins. The male F-connector is designed to be screwed onto and off of the female F-connector using the fingers. However, the relatively small surface area of the rotational connecting ring of the male F-connector can limit the amount of torque that can be applied to the connecting ring during installation. This limitation can result in a less than secure connection, especially when the cable is connected to the device in a location that is relatively inaccessible.

Accordingly, it would be advantageous to facilitate grounding continuity across cable connections while facilitating the application of torque to, for example, a male F-connector during installation.

DETAILED DESCRIPTION

Figure 1:
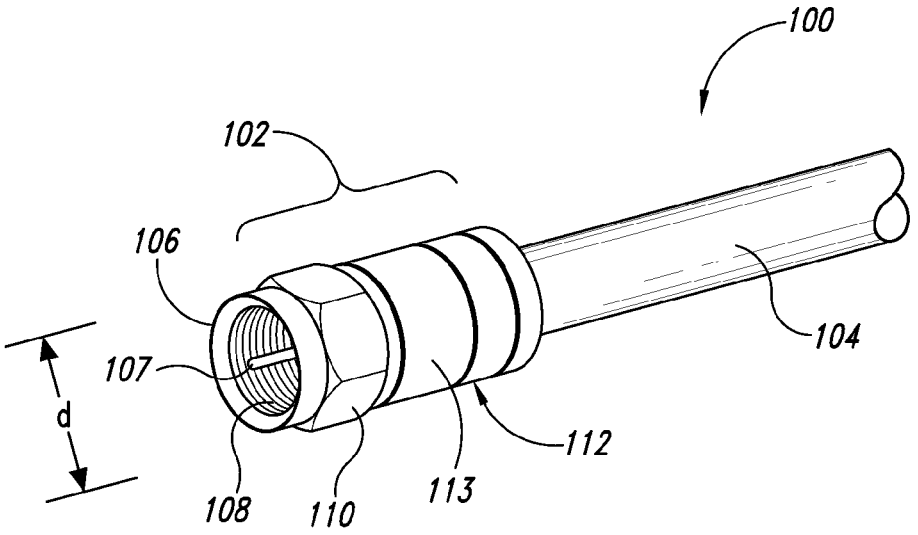
FIG. 1 is an isometric view of a coaxial cable having an F-type male connector.

The following disclosure describes apparatuses, systems, and associated methods for facilitating ground continuity across a connection of a coaxial cable and/or reducing RF interference of a signal carried by the coaxial cable. Certain details are set forth in the following description and in FIGS. 1-5E to provide a thorough understanding of various embodiments of the disclosure. Those of ordinary skill in the relevant art will appreciate, however, that the technology disclosed herein can have additional embodiments that may be practiced without several of the details described below and/or with additional features not described below. In addition, some well-known structures and systems often associated with coaxial cable connector systems and methods have not been shown or described in detail below to avoid unnecessarily obscuring the description of the various embodiments of the disclosure.

The dimensions, angles, features, and other specifications shown in the figures are merely illustrative of particular embodiments of the disclosure. Accordingly, other embodiments can have other dimensions, angles, features, and other specifications without departing from the scope of the present disclosure. In the drawings, identical reference numbers identify identical, or at least generally similar, elements. To facilitate the discussion of any particular element, the most significant digit or digits in any reference number refers to the figure in which that element is first introduced. For example, element 222 is first introduced and discussed with reference to FIG. 2.

FIG. 1 is an isometric view of a cable assembly 100 having a connector, for example, a male F-connector 102 attached to an end portion of a coaxial cable 104. The coaxial cable 104 has a central conductor 107. The male F-connector 102 has a rotatable connecting ring 106 having a diameter d with a threaded inner surface 108 and a hexagonal outer surface 110. A sleeve assembly 112 having an outer surface 113 is compressed onto an exposed metal braid (not shown) of the coaxial cable 104 in a manner well known in the art.

Figure 2A:
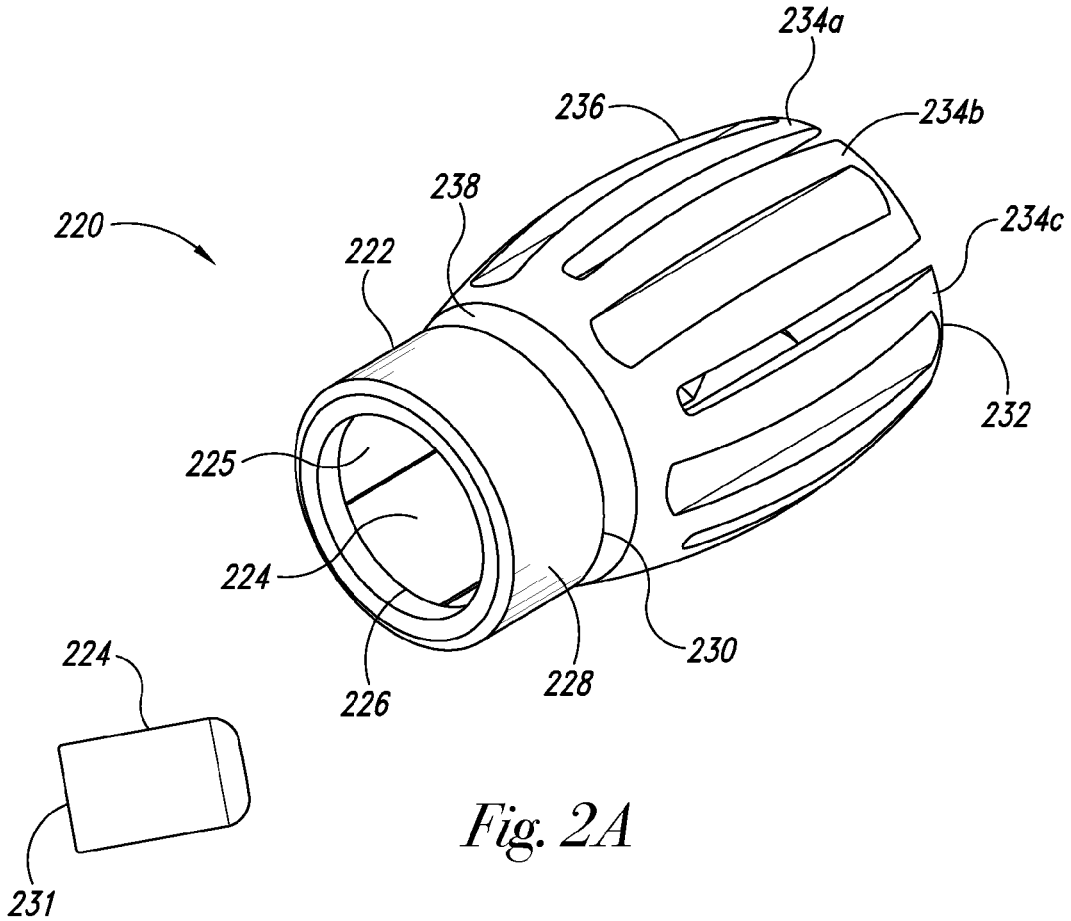
FIG. 2A is an isometric view of a jumper sleeve having a ground continuity element configured in accordance with an embodiment of the present disclosure.
Figure 2B:
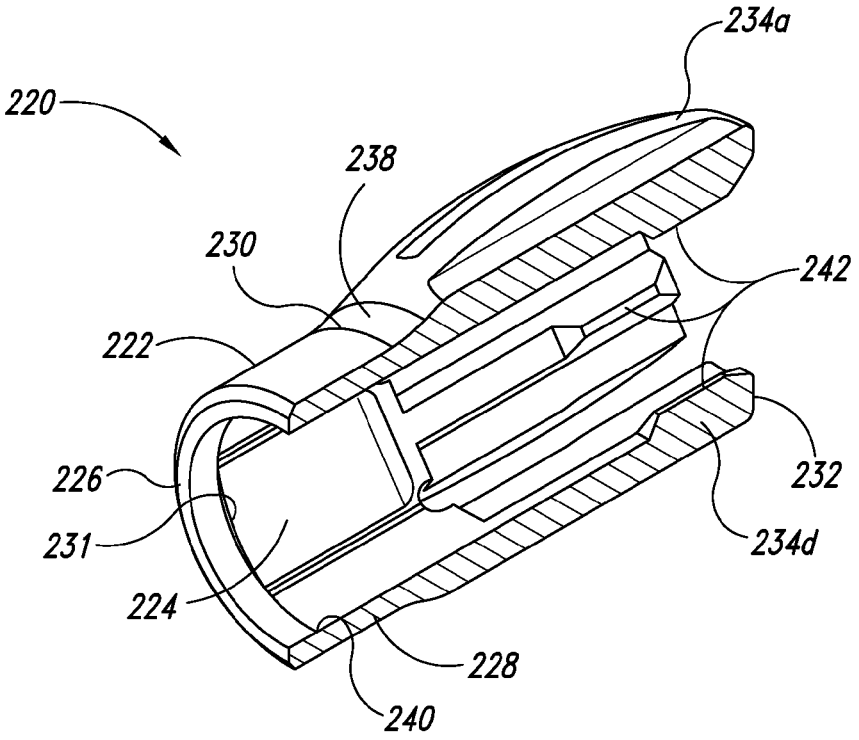
FIG. 2B is an isometric cross-sectional view of a jumper sleeve having a ground continuity element configured in accordance with an embodiment of the present disclosure.
Figure 2C:
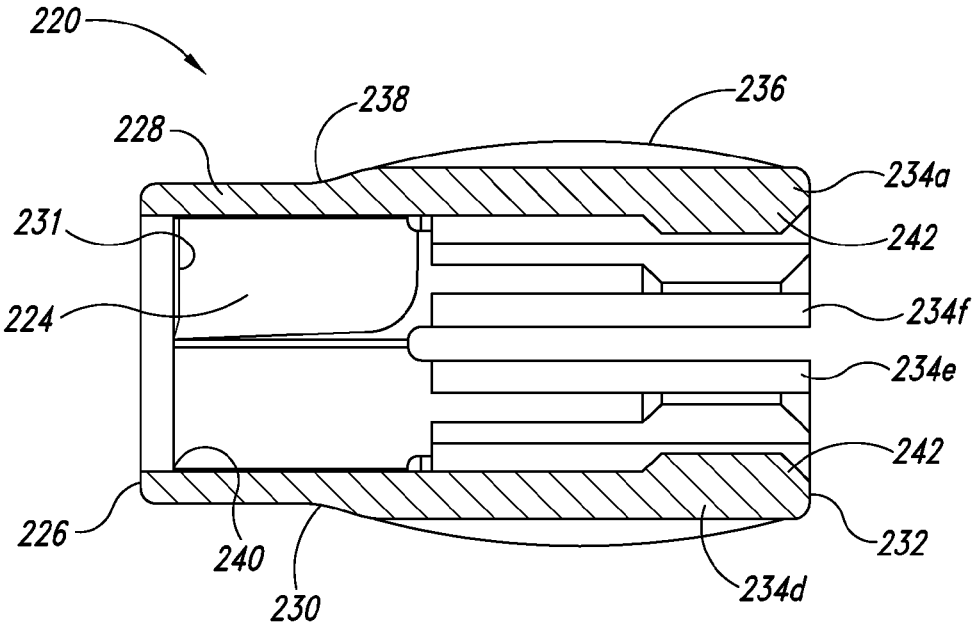
FIG. 2C is a side cross-sectional view of a jumper sleeve having a ground continuity element configured in accordance with an embodiment of the present disclosure.

FIGS. 2A-2C are isometric, isometric cross-sectional, and side cross-sectional views, respectively, of a jumper sleeve 220 configured in accordance with an embodiment of the disclosure. The jumper sleeve 220 has a generally tubular body with a wrench portion 222 and a grip portion 236. The wrench portion 222 has a hollow wrench body 228 extending between a proximal end 223 and a distal end 230. The wrench body 228 has a front opening 226 and a shaped inner surface 225 configured to receive and at least partially grip the hexagonal outer surface 110 of the male F-connector 102 (FIG. 1). In the illustrated embodiment, for example, the inner surface 225 has a hexagonal shape. In other embodiments, the inner surface 225 can have other shapes and features to facilitate receiving and/or gripping the male connector 102. In some embodiments, the jumper sleeve 220 can be made from, for example, plastic, rubber, and/or metal. While in other embodiments, the jumper sleeve may be made from other suitable materials known in the art.

In one aspect of this embodiment, a ground continuity element 224 is attached to a portion of the hexagonal inner surface 225. The ground continuity element 224 is configured to conductively engage the hexagonal outer surface 110 of the connecting ring 106 and the outer surface 113 of the sleeve assembly 112 to maintain ground continuity throughout the coaxial cable assembly 100 when connected to an electrical device and/or other cable. In the illustrated embodiment, the ground continuity element 224 is a resilient, thin metal plate made from, for example, a conductive material such as copper beryllium, brass, etc. In other embodiments, the ground continuity element 224 can be made from other suitable conductive materials known in the art. Furthermore, in the illustrated embodiment, there is one ground continuity element 224. However, in other embodiments, two or more ground continuity elements 224 may be positioned circumferentially around the inner surface 225 of the wrench body 228.

In the illustrated embodiment of FIGS. 2A-2C, the grip portion 236 is a cask-shaped hollow member having a proximal end 238 and a distal end 232. A plurality of convex grip members 234 (identified individually as grip members 234*a*-234*f*) extend away from the proximal end 238 of the grip portion 236. When the male F-connector 102 is inserted into the jumper sleeve 220, the grip members 234 allow for application of greater torque to the rotatable connecting ring 106 than could otherwise be achieved with direct manual rotation of the hexagonal outer surface 110 of the male F-connector 102. As shown in FIG. 2B, an inner key 242 protrudes from each of the grip members 234 to retain the male F-connector 102 in the jumper sleeve 220 and preventing its egress from the distal end 232 of the grip portion 236. Similarly, a shoulder portion 240 is configured to prevent the male F-connector 102 from slipping out of the proximal end 238 of the wrench body 228. In this way, the jumper sleeve 220 can be configured for permanent attachment to the male F-connector 102. In some embodiments, however, the jumper sleeve 220 can be configured to be releasably attached to the male F-connector.

Figure 2D:
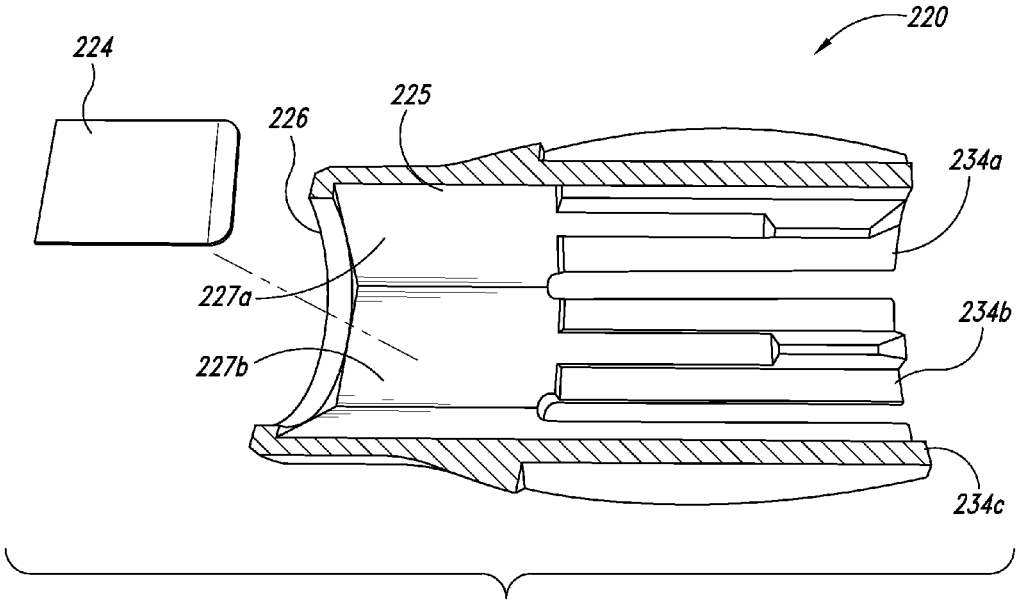
FIGS. 2D and 2E are isometric cross-sectional views of the jumper sleeve 220 prior to and after, respectively, installation of the ground continuity element 224 in accordance with an embodiment of the present disclosure.
Figure 2E:
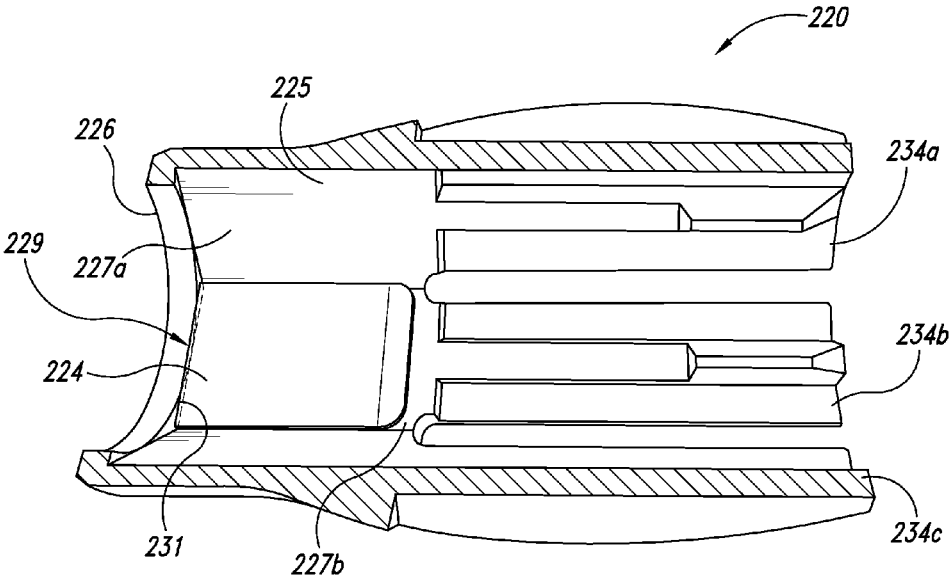

FIGS. 2D and 2E are side cross-sectional views of the jumper sleeve 220 prior to and after, respectively, installation of the ground continuity element 224 in accordance with an embodiment of the present disclosure. FIG. 2D depicts the ground continuity element 224 prior to installation in the jumper sleeve 220. A plurality of longitudinal inner grooves 227 (identified individually as grooves 227*a*-*c*) is circumferentially formed around the inner surface 225. Each of the grooves 227 is configured to receive and/or releasably engage an individual ground continuity element 224. For example, the grooves 227 can have a shape and/or depth suitable for snapping around or otherwise accepting the ground continuity element 224, holding it in place within the jumper sleeve 220.

FIG. 2E depicts the ground continuity element 224 after installation in the jumper sleeve 220. An operator can install the ground continuity element 224 by first inserting a leading edge portion 231 of the ground continuity element 224 through the distal end 232 (FIG. 2A) of the jumper sleeve 220 toward the opening 226. In the illustrated embodiment, the leading edge portion 231 snaps into the groove 227*b*, and the jumper sleeve 220 is ready to be installed onto a male F-connector. In some embodiments, the leading edge portion 231 can slide or otherwise releasably engage a lateral lip or slot 229 formed along an internal surface portion of the adjacent opening 226. In other embodiments, the ground continuity element 224 can be cast into, bonded, welded, or otherwise integrated or attached to the jumper sleeve 220 during manufacture.

Figure 3A:
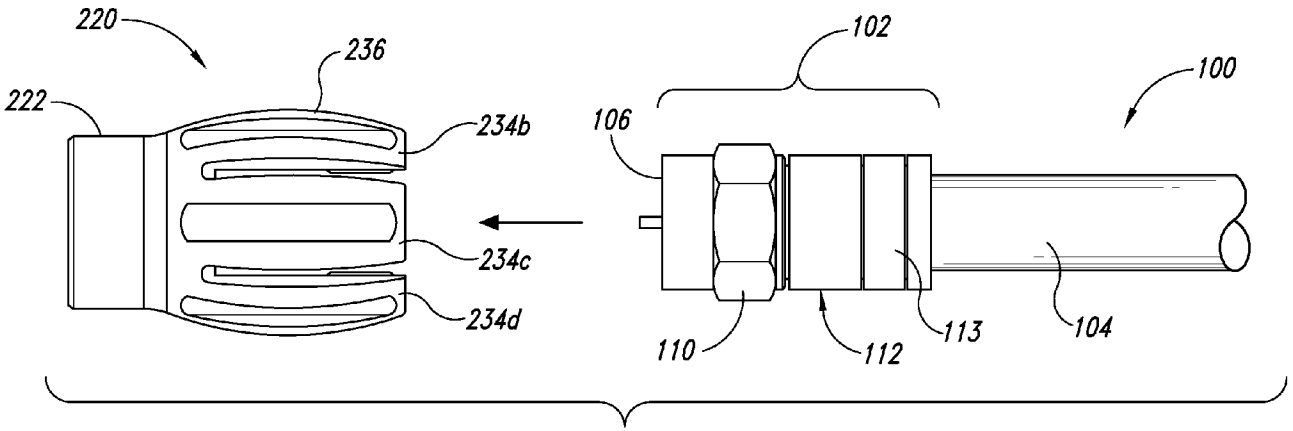
FIG. 3A is a side view of a jumper sleeve and a coaxial cable prior to installation of the jumper sleeve in accordance with an embodiment of the present disclosure.
Figure 3B:
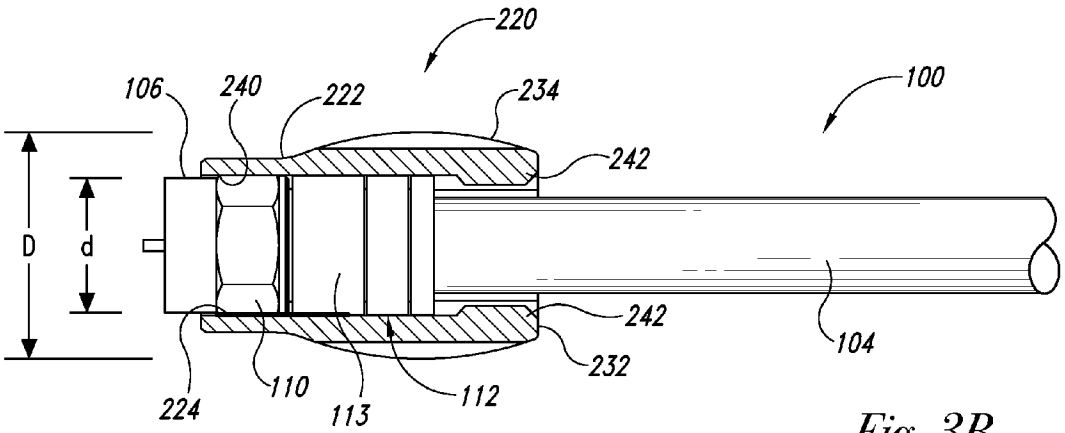
FIG. 3B is a cross-sectional side view of the jumper sleeve and coaxial cable of FIG. 3A after installation of the jumper sleeve in accordance with an embodiment of the present disclosure.

FIG. 3A depicts the coaxial cable assembly 100 before installation of the jumper sleeve 220. FIG. 3B illustrates a side view of the coaxial cable assembly 100 and a cross-sectional view of the jumper sleeve 220 after installation of the jumper sleeve 220. Referring to FIGS. 3A and 3B together, during installation, the male F-connector 102 is fully inserted into the jumper sleeve 220. The inner surface 225 of the wrench body 228 accepts the hexagonal outer surface 110 of the male F-connector 102, and the inner keys 242 and the shoulder portion 240 retain the male F-connector 102 in the jumper sleeve 220.

A larger outer diameter D and corresponding larger surface area of the gripping portions 234 offer a mechanical advantage for applying increased torque to the rotatable connecting ring 106 of the male F-connector 102 during installation. Thus, the jumper sleeve 220 facilitates a more efficient and secure connection of the male F-connector 102 to a female F-connector than might be achievable without the jumper sleeve 220. As shown in FIG. 3B, the ground continuity element 224 is retained in situ between the jumper sleeve 220, hexagonal outer surface 110, and the outer surface 113 of the sleeve assembly 112. The ground continuity element 224 conductively engages or contacts one of the "flats" of the hexagonal outer surface 110 and the outer surface 113 to maintain a metal-to-metal ground path throughout the male F-connector 102 and the coaxial cable 104, thereby enhancing signal quality.

Figure 4A:
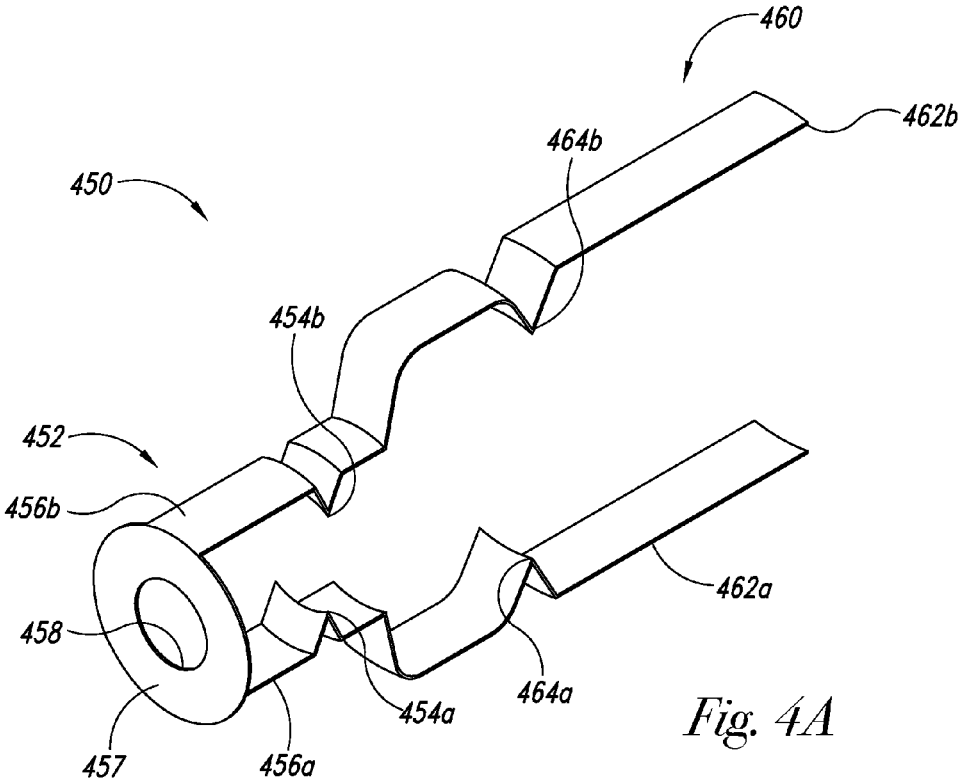
FIG. 4A is an isometric view of a ground continuity element in accordance with another embodiment of the disclosure.
Figure 4B:
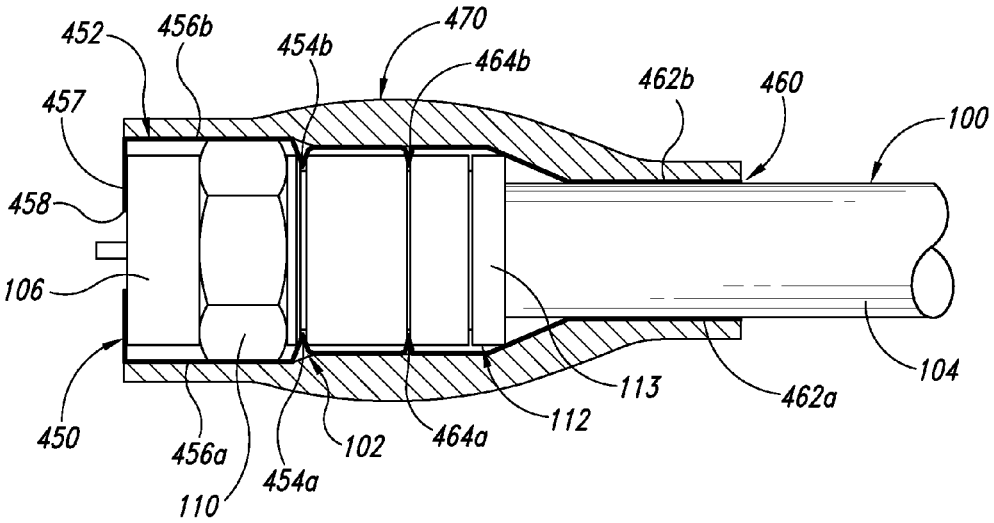
FIG. 4B is a side cross-sectional view of a jumper sleeve having the ground continuity element of FIG. 4A installed therein.

FIG. 4A is an isometric view of a ground continuity element 450 configured in accordance with another embodiment of the disclosure. FIG. 4B is a side cross-sectional side view of the ground continuity element 450 installed in a jumper sleeve 470 that is installed onto the coaxial cable assembly 100. Referring first to FIG. 4A, the ground continuity element 450 includes a proximal end portion 452 and a distal end portion 460. The proximal end portion 452 is configured to conductively engage the connecting ring 106 of the male F-connector 102 of the coaxial cable assembly 100. The distal end portion 460 includes one or more tines 462 (referred to individually as a first tine 462*a* and a second tine 462*b*). The tines 462 each have a shield protrusion 464 (identified individually as a first shield protrusion 464*a* and a second shield protrusion 462*b*) configured to conductively engage or contact the outer surface 113 of the sleeve assembly 112 of the male F-connector 102. Each tine 462 also includes a ring protrusion 454 (identified individually as a first ring protrusion 454*a* and a second ring protrusion 454*b*) near the proximal portion 452. The ring protrusions 454 are configured to conductively engage or contact the connecting ring 106. The hexagonal elements 456 (identified individually as a first hexagonal element 456*a* and a second hexagonal element 456*b*) are similarly configured to conductively engage the hexagonal outer surface 110 of the connecting ring 110. A front annular panel 457 is configured to be sandwiched between the male F-connector 102 and a corresponding female connector, or otherwise conductively engage the female F-connector when the male F-connector 102 is fully installed. An aperture or central hole 458 in the panel 457 allows the central conductor 107 of the coaxial cable 104 to pass therethrough for suitable engagement with a corresponding female F-connector.

Figure 5A:
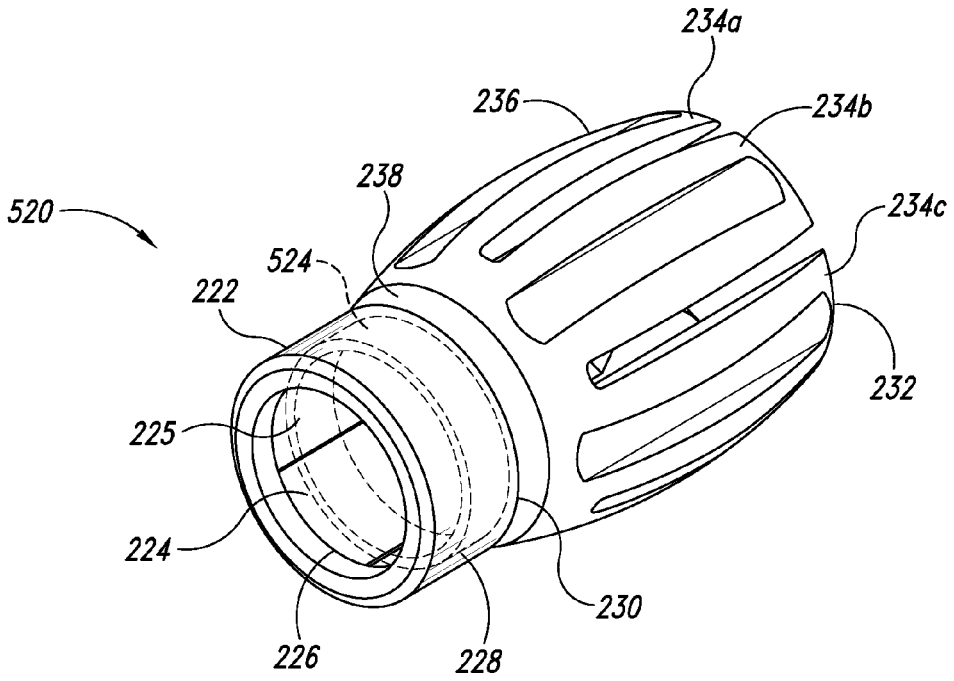
FIGS. 5A-5C are isometric, isometric cross-sectional, and side cross-sections views, respectively, of a jumper sleeve having a ferrite element configured in accordance with an embodiment of the present disclosure.
Figure 5B:
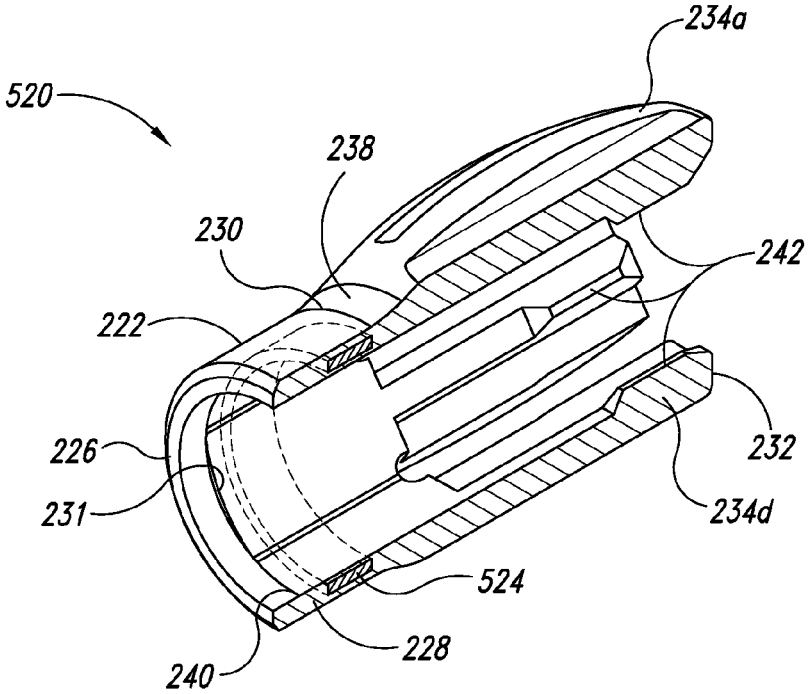
Figure 5C:
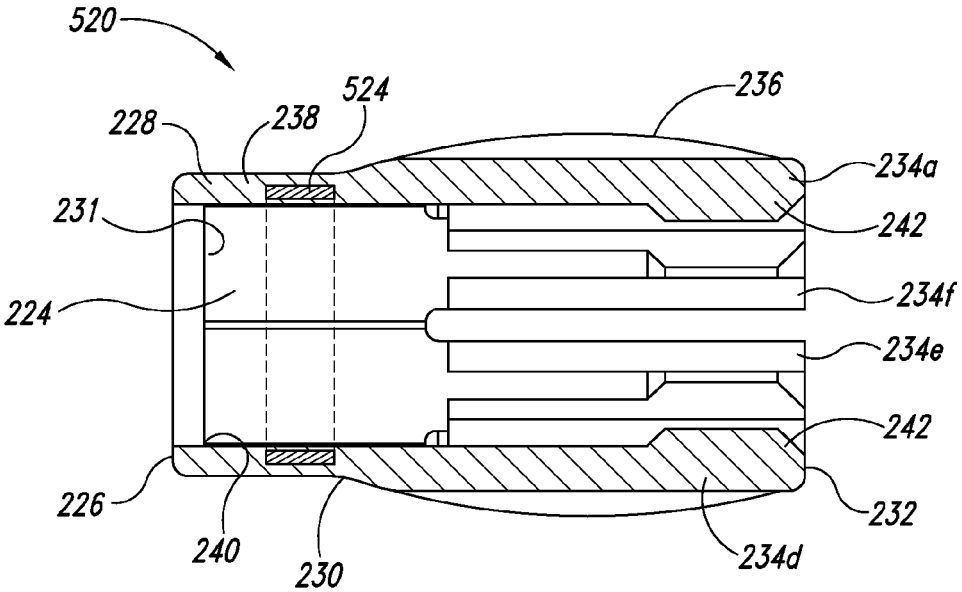

FIGS. 5A-5C are isometric, isometric cross-sectional, and side cross-sectional views, respectively, of a jumper sleeve 520 having a ferrite core or a ferrite element 524 configured in accordance with an embodiment of the disclosure. The ferrite element 524 may be disposed in, on, and/or around a portion of the jumper sleeve 520. The ferrite element 524 can be made from any suitable permanently or temporarily magnetic material. For example, the ferrite element 524 can be made from one or more soft ferrites such as (but not limited to) iron ferrite, manganese ferrite, manganese zinc ferrite, and nickel zinc ferrite.

Referring to FIGS. 5A-5C together, the ferrite element 524 can be formed into a ring that is circumferentially disposed within the wrench portion 222. While the ferrite element 524 is shown in FIGS. 5A-5C as having a length that is less than the total length of the wrench portion 222, in other embodiments, for example, the ferrite element 524 can have a shorter or longer length. In some embodiments, for example, the ferrite element can have a length that is equal to or greater than the length of the wrench portion 222 (e.g., the ferrite element can extend into and/or onto the grip portion 236). In further embodiments, for example, the entire jumper sleeve 520 can be made from the ferrite element 524.

In the illustrated embodiment of FIGS. 5A-5C, the ferrite element 524 is shown as a ring or a band embedded within the jumper sleeve 520. In other embodiments, however, the ferrite element 524 can have any suitable shape (e.g., a coil, a helix, a double helix) in and/or around the jumper sleeve 520. In some embodiments, for example, the ferrite element 524 can have roughly the same shape (e.g., a hexagonal tube or core) as the shaped inner surface 225. Furthermore, in the illustrated embodiment, the ferrite element 524 is shown as having approximately the same thickness as the jumper sleeve 520. In other embodiments, however, the ferrite element 524 can have any suitable thickness. As discussed in further detail below, it may be advantageous, for example, to vary the thickness of the ferrite element 524 to attenuate a particular frequency range of RF interference.

Figure 5D:
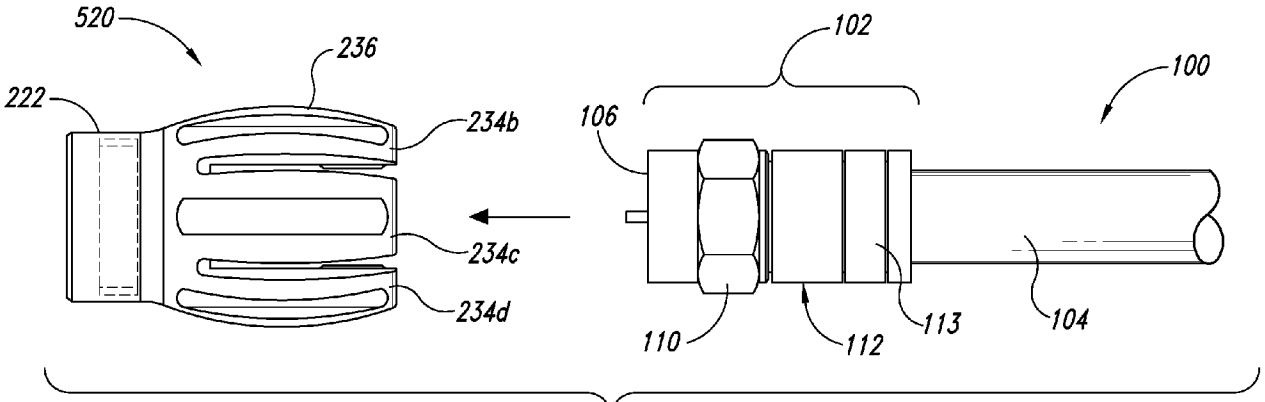
FIG. 5D is a side view of a jumper sleeve and a coaxial cable prior to installation of the jumper sleeve in accordance with an embodiment of the present disclosure.
Figure 5E:
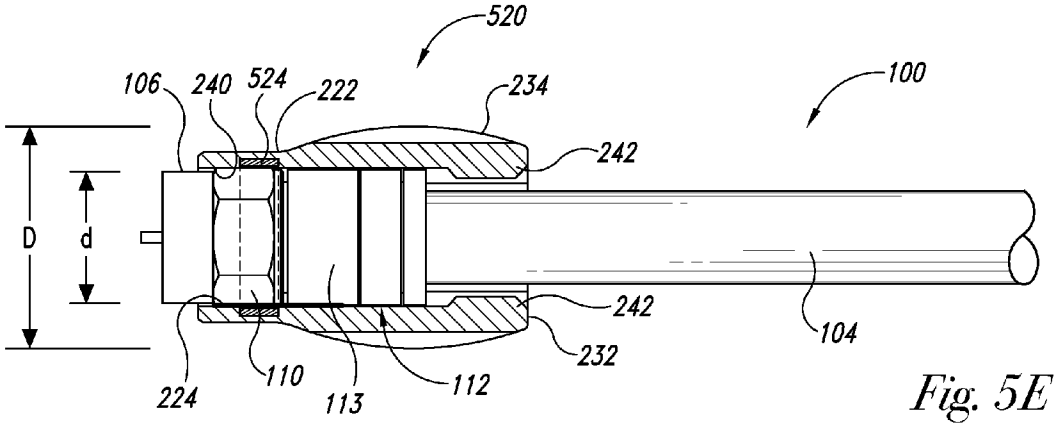
FIG. 5E is a cross-sectional side view of the jumper sleeve and coaxial cable of FIG. 5D after installation of the jumper sleeve in accordance with an embodiment of the present disclosure.

FIG. 5D depicts the coaxial cable assembly 100 before installation of the jumper sleeve 520. FIG. 5E illustrates a side view of the coaxial cable assembly 100 and a cross-sectional view of the jumper sleeve 520 after installation of the jumper sleeve 520. Referring to FIGS. 5D and 5E together, during installation, the male F-connector 102 is fully inserted into the jumper sleeve 520. In the illustrated embodiment, the jumper sleeve 520 is lockably fitted to the male F-connector 102. In other embodiments, however, the jumper sleeve 520 can be configured to be removable to facilitate use on one or more other cable assemblies 100.

As those of ordinary skill in the art will appreciate, placing a ferrite material at or near a cable termination can be effective in suppressing interference of a signal carried by a coaxial cable. The present technology offers the advantage of placing a ferrite material (e.g., the ferrite element 524) very proximate to the male F-connector 102 while aiding in the fitment of the male F-connector 102 to a female F-connector. As those of ordinary skill in the art will further appreciate, for example, an RF shield current can form along an outer surface of the cable 104 shield or jacket, causing RF interference in a signal carried by the cable 104 (e.g., a signal carried by the central conductor 107). Placing the jumper sleeve 520 (having the ferrite element 524 therein and/or thereon) onto the male F-connector 102, however, can reduce RF interference of a signal carried within the cable 104 by attenuating the RF shield current along the cable 104 more effectively than, for example, the jumper sleeve 520 alone. The ferrite element 524 can be further configured to attenuate particular frequencies of RF interference by adjusting, for example, the width and/or the thickness of the ferrite element 524. The effectiveness of the ferrite element 524 can be further adjusted, for example, by varying the impedance of the ferrite element 524; the chemical composition of the ferrite element 524; and/or the number of turns of the ferrite element 524 around the cable 104

Figure 5F:
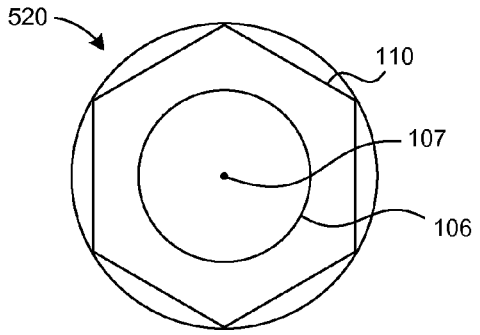
FIGS. 5F and 5G are front schematic views of a jumper sleeve in a clamshell configuration in accordance with an embodiment of the present disclosure.
Figure 5G:
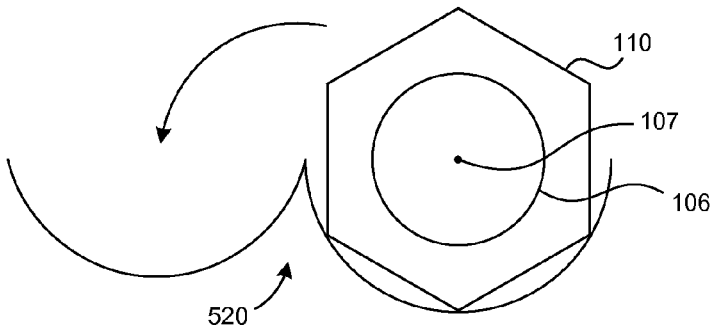

In some embodiments, for example, the ferrite element 524 can be configured to be retrofitted or otherwise placed in and/or on the jumper sleeve 520 after fitment to the male F-connector 102. For example, as shown in FIGS. 5F and 5G, the jumper sleeve 520 and/or the ferrite element 524 can be configured in a removable clamshell configuration. In some other embodiments, for example, a groove (not shown) can be formed on an external surface of the jumper sleeve 520 (e.g., along the wrench portion 222) and configured to receive the ferrite element 524 for installation after the jumper sleeve 520 has already been attached to the male F-connector 102. In some further embodiments, the jumper sleeve 520 can be configured to receive additional and/or different ferrite elements 524 based on cable configuration and/or conditions. For example, an additional ferrite element 524 can be added to the jumper sleeve 520 already having a ferrite element 524 therein and/or thereon. As those of ordinary skill in the art will appreciate, adding one or more additional ferrite elements 524 may have the effect of further reducing RF interference within the cable. In yet further embodiments, the ferrite element 524 can be configured as a wire having one or more coils in and/or around the jumper sleeve 520.

The foregoing description of embodiments of the invention is not intended to be exhaustive or to limit the disclosed technology to the precise embodiments disclosed. While specific embodiments of, and examples for, the invention are described herein for illustrative purposes, various equivalent modifications are possible within the scope of the invention, as those of ordinary skill in the relevant art will recognize. For example, although certain functions may be described in the present disclosure in a particular order, in alternate embodiments these functions can be performed in a different order or substantially concurrently, without departing from the spirit or scope of the present disclosure. In addition, the teachings of the present disclosure can be applied to other systems, not only the representative coin sorting systems described herein. Further, various aspects of the invention described herein can be combined to provide yet other embodiments.

In general, the terms used in the following claims should not be construed to limit the invention to the specific embodiments disclosed in the specification, unless the above-detailed description explicitly defines such terms. Accordingly, the actual scope of the disclosure encompasses the disclosed embodiments and all equivalent ways of practicing or implementing the disclosure under the claims.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below," and words of similar import, when used in this application, shall refer to this application as a whole and not to any particular portions of this application. When the claims use the word "or" in reference to a list of two or more items, that word covers all of the following interpretations of the word: any of the items in the list, all of the items in the list, and any combination of the items in the list.

From the foregoing, it will be appreciated that specific embodiments of the disclosed technology have been described herein for purposes of illustration, but that various modifications may be made without deviating from the invention. Certain aspects of the disclosure described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the disclosed technology. Accordingly, the disclosure and associated technology can encompass other embodiments not expressly shown or described herein. The following statements are directed to embodiments of the present disclosure.

The invention claimed is:

1. A device for attaching a male F-connector to a female F-connector, the device comprising:

a tubular body configured to receive a male coaxial cable connector and allow connection and disconnection of the male coaxial cable connector with a female coaxial cable connector, the male coaxial cable connector having a rotatable ring rotatably coupled to a sleeve; and a conductive element disposed on an inner surface of the tubular body, wherein the conductive element is configured to conductively contact the rotatable ring and the sleeve to maintain ground path continuity between the male coaxial cable connector and a corresponding female coaxial cable connector after attachment thereto.

2. The device of claim 1 wherein the tubular body includes a wrench portion having a hexagonal inner surface configured to receive a coaxial cable connector rotatable ring.

3. The device of claim 1 wherein the tubular body includes a grip portion comprising one or more grip members extending away from a proximal end portion toward a distal end portion.

4. The device of claim 1 wherein the conductive element is made from copper beryllium.

5. The device of claim 1 wherein the conductive element comprises a metal plate.

6. The device of claim 1 wherein the conductive element includes a leading edge configured to engage a slot formed along an internal surface of the tubular body.

7. The device of claim 1 wherein the conductive element includes— an annular panel configured to be disposed between the male coaxial cable connector and the female coaxial cable connector, wherein the annular panel includes an aperture to allow a central conductor of a coaxial cable to pass therethrough; and at least a first tine extending from the annular panel, wherein at least a portion of the first tine is configured to be in contact with the male coaxial cable connector.

8. The device of claim 7 wherein the first tine includes a shield protrusion and a ring protrusion, wherein the shield protrusion is configured to conductively engage at least a portion of a shield of the male coaxial cable connector, and wherein the ring protrusion is configured to conductively engage at least a portion of the rotatable ring of the male coaxial cable connector.

9. A device for reducing interference of a signal carried within a coaxial cable, the device comprising:

a tubular body configured to receive a male coaxial cable connector and facilitate connection and disconnection of the male coaxial cable connector with a female coaxial cable connector, wherein the tubular body includes a ferrite material configured to conductively engage the male coaxial cable connector.

10. The device of claim 9 wherein the ferrite material comprises Manganese-zinc ferrite.

11. The device of claim 9 wherein the ferrite material comprises Nickel-zinc ferrite.

12. The device of claim 9 wherein the tubular body is made from plastic.

13. The device of claim 9 wherein the tubular body includes— a wrench portion includes a hollow wrench body having a hexagonal inner surface, wherein the hexagonal inner surface is configured to receive a coaxial cable connector; and a grip portion comprising a proximal end and a distal end, wherein the grip portion includes one or more grip members extending away from the proximal end toward the distal end.

14. The device of claim 9 wherein the ferrite material is formed into a ring circumferentially disposed within the tubular body.

15. The device of claim 9 wherein the tubular body is configured as a removable clamshell.

16. The device of claim 9 wherein the ferrite material is adjacent to a rotatable ring of the male coaxial cable connector.

17. A device for reducing interference of a signal carried within a coaxial cable, the device comprising:

a tubular body configured to receive a male coaxial cable connector and facilitate connection and disconnection of the male coaxial cable connector with a female coaxial cable connector, wherein the tubular body includes a ferrite material at least proximate to the male coaxial cable connector, and wherein the tubular body is made from the ferrite material.

18. The device of claim 17 wherein the tubular body includes— a wrench portion includes a hollow wrench body having a hexagonal inner surface, wherein the hexagonal inner surface is configured to receive a coaxial cable connector; and a grip portion comprising a proximal end and a distal end, wherein the grip portion includes one or more grip members extending away from the proximal end toward the distal end.

19. The device of claim 17 wherein the tubular body is configured as a removable clamshell.

20. The device of claim 17 wherein the ferrite material comprises Manganese-zinc ferrite or Nickel-zinc ferrite.

21. A device for reducing interference of a signal carried within a coaxial cable, the device comprising:

a tubular body configured to receive a male coaxial cable connector and facilitate connection and disconnection of the male coaxial cable connector with a female coaxial cable connector, wherein the tubular body includes a ferrite material at least proximate to the male coaxial cable connector, and wherein the ferrite material is formed into a plurality of loops within the tubular body.

22. The device of claim 21 wherein the tubular body includes— a wrench portion includes a hollow wrench body having a hexagonal inner surface, wherein the hexagonal inner surface is configured to receive a coaxial cable connector; and a grip portion comprising a proximal end and a distal end, wherein the grip portion includes one or more grip members extending away from the proximal end toward the distal end.

23. The device of claim 21 wherein the ferrite material is adjacent to a rotatable ring of the male coaxial cable connector.

24. A device for reducing interference of a signal carried within a coaxial cable, the device comprising:

a tubular body configured to receive a male coaxial cable connector and facilitate connection and disconnection of the male coaxial cable connector with a female coaxial cable connector, wherein the tubular body includes a ferrite material at least proximate to the male coaxial cable connector, and wherein the ferrite material is removably attached to the tubular body within a clamshell housing.

25. The device of claim 24 wherein the tubular body includes a wrench portion having a hexagonal inner surface configured to receive a coaxial cable connector rotatable ring.

26. The device of claim 24 wherein the tubular body includes a grip portion comprising one or more grip members extending away from a proximal end portion toward a distal end portion.

27. The device of claim 24 wherein the tubular body is made of the ferrite material.

28. The device of claim 24 wherein the tubular body is made of plastic.

29. The device of claim 24 wherein the ferrite material comprises a metal plate.

30. The device of claim 24 wherein the ferrite material comprises Manganese-zinc ferrite or Nickel-zinc ferrite.

31. The device of claim 24 wherein the ferrite material is formed into a ring circumferentially disposed within the tubular body.

32. The device of claim 24 wherein the tubular body includes an internal surface, wherein the tubular body further includes a lip formed along the internal surface, and wherein the ferrite material comprises a conductive element having a leading edge configured to engage the lip.

33. The device of claim 32 wherein the conductive element comprises a thin metal plate.

34. The device of claim 24 wherein the ferrite material comprises a conductive element that includes— an annular panel configured to be disposed between the male coaxial cable connector and the female coaxial cable connector, wherein the annular panel includes an aperture to allow a central conductor of a coaxial cable to pass therethrough; and at least a first tine extending from the annular panel, wherein at least a portion of the first tine is configured to be in contact with the male coaxial cable connector.

35. The device of claim 34 wherein the first tine includes a shield protrusion and a ring protrusion, wherein the shield protrusion is configured to conductively engage at least a portion of a shield of the male coaxial cable connector, and wherein the ring protrusion is configured to conductively engage at least a portion of a rotatable ring of the male coaxial cable connector.

36. A device for attenuating interference of a signal carried by a coaxial cable, the device comprising a ground continuity element disposed in a hollow body, wherein the hollow body is configured to be attached to a male coaxial cable connector, and wherein the ground continuity element is configured to conductively engage the male coaxial cable connector when the hollow body is attached thereto.

37. The device of claim 36 wherein the ground continuity element comprises a magnetic material.

38. The device of claim 36 wherein the ground continuity element is removably insertable into the hollow body.

39. The device of claim 36 wherein at least a portion of the ground continuity element is configured to engage a slot formed in the hollow body.

40. The device of claim 36 wherein the ground continuity element is at least partially embedded in the hollow body.

41. The device of claim 36 wherein at least a portion of the ground continuity element is configured to be positioned between the male coaxial cable connector and a female coaxial cable connector connected thereto when the hollow body is attached to the male coaxial cable connector.

* * * * *

UNITED STATES PATENT AND TRADEMARK OFFICE

CERTIFICATE OF CORRECTION

PATENT NO. : 9,028,276 B2
APPLICATION NO. : 13/707403
DATED : May 12, 2015
INVENTOR(S) : Wilson et al.

It is certified that error appears in the above-identified patent and that said Letters Patent is hereby corrected as shown below:

On the title page, item [56]

On the page 2, column 2, under "U.S. Patent Documents", line 53, delete "Stoel" and insert -- Stoel et al. --, therefor.

On the page 4, column 2, under "Other Publications", line 7, delete "GRB-I"" and insert -- GRB-1" --, therefor.

In the specification

Column 6, line 22, delete "104" and insert -- 104. --, therefor.

Signed and Sealed this
Twentieth Day of October, 2015

Michelle K. Lee

Michelle K. Lee
*Director of the United States Patent and Trademark Office*